US007044266B2

(12) United States Patent
Petracek

(10) Patent No.: US 7,044,266 B2
(45) Date of Patent: May 16, 2006

(54) EXHAUST MUFFLER FOR INTERNAL COMBUSTION ENGINES

(76) Inventor: Ronald James Petracek, 1137 W. Foothill Blvd., Azusa, CA (US) 91702

( * ) Notice: Subject to any disclaimer, the term of this patent is extended or adjusted under 35 U.S.C. 154(b) by 364 days.

(21) Appl. No.: 10/714,086

(22) Filed: Nov. 13, 2003

(65) Prior Publication Data

US 2005/0103567 A1 May 19, 2005

(51) Int. Cl.
*F01N 1/08* (2006.01)
*F01N 1/02* (2006.01)

(52) U.S. Cl. ..... 181/269; 181/272; 181/249; 181/255

(58) Field of Classification Search ..... 181/269, 181/272, 268, 275, 282, 249, 251, 255, 227, 181/228
See application file for complete search history.

(56) References Cited

U.S. PATENT DOCUMENTS 2,205,899 A * 6/1940 Chipley ..... 181/269
2,732,026 A * 1/1956 Folts ..... 181/243
3,412,825 A * 11/1968 Hall ..... 181/282
4,064,962 A * 12/1977 Hunt ..... 181/272
4,074,975 A * 2/1978 Tokura et al. ..... 422/171
4,362,223 A * 12/1982 Meier ..... 181/206
4,574,914 A 3/1986 Flugger
4,809,812 A 3/1989 Flugger
5,123,502 A * 6/1992 Flugger ..... 181/264
6,089,347 A * 7/2000 Flugger ..... 181/264
6,286,623 B1 * 9/2001 Shaya ..... 181/264
6,915,877 B1 * 7/2005 Khayalian ..... 181/272

FOREIGN PATENT DOCUMENTS

JP 61207814 A * 9/1986

* cited by examiner

*Primary Examiner*—Edgardo San Martin
(74) *Attorney, Agent, or Firm*—Ronald M. Goldman

(57) ABSTRACT

Performance sound is produced with a muffler that includes a casing with front (5, 37), rear (7, 41) and side (3, 35) walls, first (9, 45) and second (11, 47) compartment walls each with a central passage (25, 28, 46, 48) and side circular passages (26, 27, 26', 27'). The first compartment wall is spaced behind the exhaust gas inlet (6, 39). The second compartment wall is spaced in front of the rear wall. A first divider baffle (21, 21') divides one side passage in the first compartment wall into a plurality of passages, and a second divider baffle (23, 23') divides the second side passage in the first compartment wall into a plurality of passages. An elongate louvered tubular member (13, 13') between the first and second compartment walls receives exhaust gas from the first compartment and permits exhaust gas to exit into the second compartment. A third divider baffle (17, 17') divides a portion of the interior of the tubular member into four sectors so exhaust gas entering the tubular member is divided into a plurality of streams.

20 Claims, 7 Drawing Sheets

EXHAUST MUFFLER FOR INTERNAL COMBUSTION ENGINES

FIELD OF THE INVENTION

This invention relates to noise reduction in engines, and, more particularly, to exhaust mufflers for attenuating engine exhaust noise generated by internal combustion engines and emitting a performance sound.

BACKGROUND

Internal combustion engines common to vehicles, such as automobiles, light trucks and sport utility vehicles, and, particularly those fueled by gasoline, inherently produce a loud and irritating roar through the engine exhaust during operation that, if not muffled, is unbearable to a person's ears. That noise generation becomes particularly loud and irritating when the gas pedal is quickly depressed, "floored", to force the engine to rapidly accelerate to a high rpm. During the exhaust portion of the four-stroke engine cycle that follows detonation of the fuel and air mixture in the cylinder, the cylinder exhaust valve associated with an engine cylinder opens and the piston, being moved upwardly in the cylinder toward the exhaust valve, forces the gaseous products of combustion from the cylinder. Typical internal combustion engines contain multiple engine cylinders, four, six or eight cylinders, as example. Each cylinder in the engine is "fired" in serial order during the associated compression stage for the cylinder. Once fired, the resulting gaseous products of combustion are exhausted from the cylinder during the succeeding exhaust stage. The repetitive expulsion of the hot exhaust gases being forced from each engine cylinder in turn and rapid expansion of those gases into the exhaust manifold generates the engine noise. The hot exhaust gas empties into the exhaust manifold and thence flows into the exhaust runners, the metal tubes leading to the catalytic converter, and from the catalytic converter passes through the muffler, and empties from the muffler to the tailpipe and, thence, to the exterior atmosphere where both the gas is expelled and the sound is broadcast. With multiple engine cylinders, the foregoing exhaust action of engine operation produces a periodic series of gas pressure pulses and the repetition rate of those pulses varies as a function of the engine rpm. Typically, that pulse rate falls in the audible range.

Because of that noise, automobiles manufactured and/or sold are required to include a sound attenuating device, commonly referred to as a muffler, to dampen the exterior exhaust sound produced by the vehicle engine to at or below the intensity level specified by law. A typical exhaust muffler provided on the gasoline fueled automobiles of major automobile manufacturers, "the OEM muffler," contains several perforated pipes housed within a closed chamber. One of those pipes, the inlet pipe, empties into a front chamber within the housing or casing and the second pipe provides an exit from a rear chamber. A resonator chamber located at the front of the housing is also coupled by a pipe or passage to the rear of the first chamber. Sound reduction in the muffler relies upon the sound cancellation produced by having reflected and direct portions of the exhaust gas pulse combine in opposite phase inside the muffler so that the sound released through the tailpipe is reduced in level.

Because the pulses of exhaust gas introduced into the muffler must pass through the inlet pipe and exit against a wall in the first chamber and thence return to the middle chamber, one effect of the presence of the wall is to produce a back-pressure at the inlet. Although the OEM muffler dampens the harsh sounds produced at the outlet of the tailpipe below the legal limit for sound, the obstruction created by the chamber wall inside the muffler housing produces a back pressure in the exhaust path from the manifold. To overcome the effect of that back pressure, the engine must perform extra work in pumping out the exhaust gas. In effect, the back pressure robs the engine of some amount of horsepower that could otherwise be obtained from the engine if the exhaust gas were exhausted directly to the atmosphere.

To reduce that back pressure and increase the available horsepower from the engine, performance mufflers were introduced as an after-market product to replace the OEM muffler. Serious performance aficionados could then replace the original equipment muffler with a performance muffler and achieve both better performance and a more desirable sound from the tailpipe.

Performance mufflers currently being marketed are designed to function by one of two basic techniques. One design incorporates fiberglass matting, a sound absorbent material on the outer walls of a perforated tube. The matting absorbs the sound of the resonant audio frequency produced by the exhaust gas as the exhaust gas moves through the perforations in the tube and dampens the sound to tolerable levels within the legal limit. Unfortunately, the matting often breaks down after prolonged use and is discharged into the tailpipe. The matting also absorbs oil and metallic minerals as may be included in the exhaust gases. The accumulation of those substances reduces the sound absorbency of the matting and, hence, the ability of the muffler to absorb or dampen the exhaust sound level. When that occurs, the muffler must be replaced.

The better performance mufflers rely on a chamber single deflector technology which does not require a packing of sound absorbent material. Instead the muffler permits the exhaust gases to flow through the muffler and exit the tail pipe more easily than the OEM packed muffler and produces a lower back pressure. The exhaust gases are directed in a path inside the muffler housing defined by internal metal baffles. Exhaust gas introduced into the performance muffler is directed through internal chambers to the right and the left of the muffler inlet. The foregoing path for the exhaust gas is less restrictive and permits the engine to develop greater horsepower than the absorbent packed muffler, while producing a deep throated rumbling sound desired by many as an advertisement of the power of their automobile engine, often called performance sound. Performance mufflers of the foregoing type have been available for some time from the Flowmaster Company of Santa Rosa, Calif. and variations of that muffler are described in U.S. Pat. Nos. 4,574,914, 4,809,812 and 5,123,502 to which the reader may make reference.

The adaptation of emission controls on automobile internal combustion engines resulted in making combustion more efficient and lowered exhaust gas temperatures and catalytic converters were included in the routing of the exhaust gas, all of which aids the effectiveness and/or reliability of an exhaust gas muffler. However, although of aid, those additional systems are not for the purpose of muffling engine noise at the exterior below the sound limit and do not do so.

Although solving the problem of exterior noise as might be experienced by a bystander to the vehicle, the muffler should also minimize the engine noise that reaches the interior of the automobile and could be disturbing to the automobile owner, in practice, one finds that OEM mufflers and performance mufflers don't always provide appropriate muffling under all driving conditions. As example, it is found that the internal combustion engine of many sport utility vehicle produces a sound in the interior of the vehicle that is discomforting, if not irritating, that occurs when the engine is operating at about 2200 rpm, which typically corresponds to driving the automobile at a speed of about sixty miles per hour, a typical cruising speed. The engine also produces that annoying sound on acceleration as the engine passes through the 2200 rpm speed. Though the muffler achieves sufficient quietude at other speeds, it appears to produce or allow a resonance inside the vehicle cabin at the 2200 rpm engine speed, which is obviously undesirable.

Then too, when the engine is operating at a high speed above 2200 rpm and the driver removes his foot from the accelerator pedal to allow the vehicle to decelerate, an annoying crackling or "popping" sound is produced inside the cabin that originates at the muffler. That sound is disconcerting to most drivers who may think an engine backfire is imminent. Small pick-up trucks experience a similar problem with cabin sound that the muffler fails to handle when the truck is placed under a heavy load, such as when towing a camper or recreational vehicle, horse trailer or the like.

Muffler durability is also a problem. One finds that some performance mufflers develop hot spots on the muffler case during engine operation. Sometimes the intensity of a hot spot is so great as to produce through localized thermal expansion a bulge in the side of the metal muffler case. That thermal action is likely to lead to a break through in the side of the muffler through which exhaust gases and sound escapes to the exterior. Should that occur, the muffler must be replaced. The foregoing hot spots appear to inherently result from the effect of the baffles located inside the performance muffler, earlier noted. Apparently, a portion of the exhaust gas passing through the muffler is diverted by the internal baffles to create localized vortexes of hot gases in the interior of the muffler. Those vortexes remain stationary in location and don't readily exit the muffler, producing steady heating at a spot on the side of the muffler that, like a blowtorch, ultimately burns through the metal of the muffler case. As an advantage, the present invention avoids such burn-through.

Even before any burn-through occurs, the very high temperatures produced by such hot spots in the performance muffler often results in driver discomfort or increased fuel consumption. Located on the undercarriage of the vehicle the heat from the muffler is conducted or convected in some measure through the vehicle flooring to the interior of the automobile, which, in the summer, is discomforting to the driver, if automobile air conditioning is unavailable. If air conditioning is available, prolonged operation of the air conditioner is necessary to dissipate the accumulating heat and maintain a comfortable cabin temperature. But prolonged operation of the air conditioner results in greater gasoline consumption, lowering overall engine efficiency. As an advantage, the present invention avoids heating the interior of the vehicle to such a degree.

The OEM mufflers are principally designed to muffle sound. Performance mufflers, on the other hand, are designed to reduce the intensity of the exhaust sound and also produce a satisfying sound of low frequency and timbre characteristic of performance vehicles. That sound is sometimes referred to by auto enthusiasts, including the present inventor, as a performance sound. Psychologically, the performance sound gives an audible clue that the vehicle contains great horsepower. Difficult to describe with words and lacking precise definition, the sound may be said to be one that one knows when one hears the sound. As an advantage, the present invention also delivers performance sound.

The foregoing difficulties were noted in exhaust gas mufflers used for gasoline fueled internal combustion engines. Many light trucks and some automobiles today instead use diesel fueled internal combustion engines. Operated without a muffler, the sound generated during operation of the diesel engine is typically of an acceptable frequency or timbre, but the sound produced is also uncomfortably loud and must also be muffled. As a further advantage, the present invention can be employed with diesel engines.

Accordingly, an object of the present invention is to muffle the sound of the exhaust gas exhausted from an internal combustion engine and instead permit generation of a performance sound.

An additional object of the present invention is to minimize or prevent the appearance of annoying engine exhaust sounds in the vehicle interior over the normal range of engine speed, while limiting the sound appearing exterior of the vehicle below the legal limit of loudness and providing a performance sound.

A further object of the invention is to prevent the appearance of annoying sounds within the driver's compartment of a vehicle during normal driving speeds and under heavy loads while maintaining exterior sound of sufficiently low level.

And, an ancillary object of the invention is to improve the thermal stability and operational reliability of the exhaust gas muffler for an internal combustion engine, and, more specifically, provide a muffler structure that does not develop hot spots in the casing wall of the muffler during engine operation.

SUMMARY OF THE INVENTION

Performance sound is produced with a muffler that includes a casing with front, rear and side walls, first and second compartment walls, each with a central passage and a pair circular side passages. The first compartment wall is spaced behind the exhaust gas inlet and the second compartment wall is spaced in front of the rear wall. A first divider baffle divides one side passage in the first compartment wall into a plurality of passages, and a second divider baffle divides the second side passage in the first compartment wall into a plurality of passages. An elongate louvered tubular member between the first and second compartment walls receives exhaust gas from the first compartment and permits exhaust gas to exit into the second compartment. A third divider baffle divides a portion of the interior of the tubular member into four sectors so exhaust gas entering the tubular member is divided into a plurality of streams.

The foregoing and additional objects and advantages of the invention, together with the structure characteristic thereof, which were only briefly summarized in the foregoing passages, will become more apparent to those skilled in the art upon reading the detailed description of a preferred embodiment of the invention, which follows in this specification, taken together with the illustrations thereof presented in the accompanying drawings.

DETAILED DESCRIPTION OF THE PREFERRED EMBODIMENTS

Figure 1:
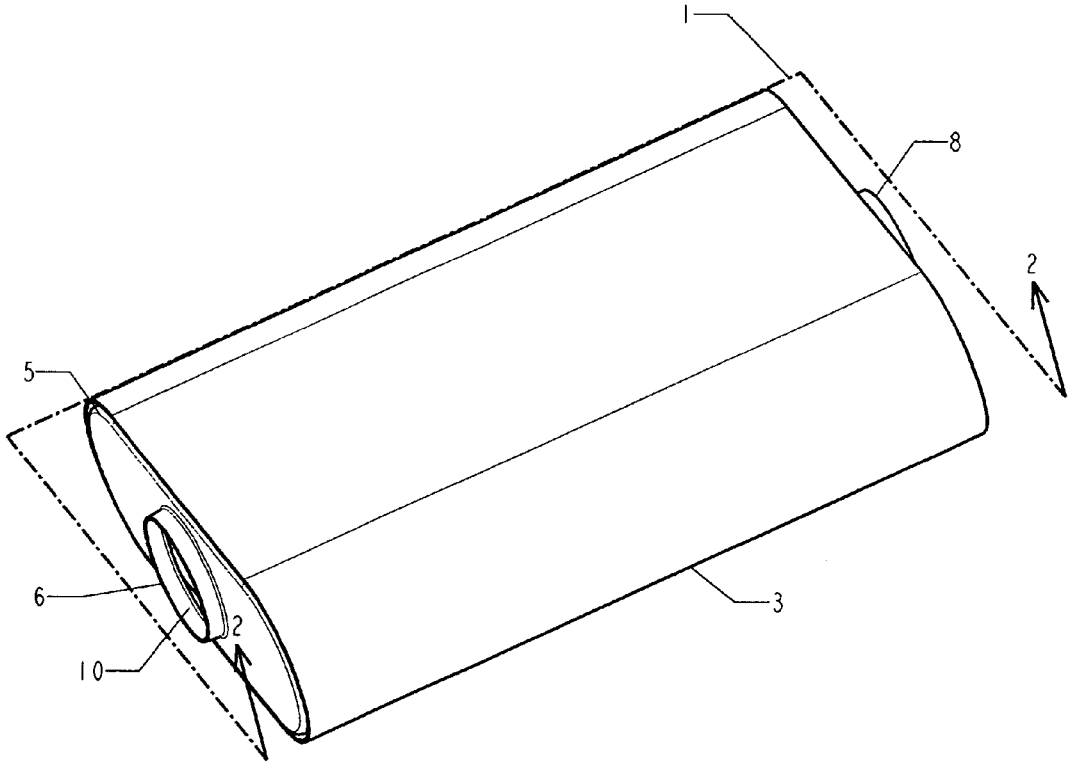
FIG. 1 illustrates the exterior of a preferred embodiment of the invention adapted for a gasoline fueled internal combustion engine.

An exterior view of a muffler 1 constructed in accordance with the invention is illustrated in FIG. 1 to which reference is made. The muffler includes a metal housing or case, containing a curved metal side wall or casing 3, thin metal front and rear walls, 5 and 7, respectively, of elliptical shape. The case is formed by wrapping a metal sheet or casing 3 around the elliptical periphery of the front and rear walls, and, once all internal components are in place, welding the ends of the formed side wall together along a longitudinally extending seam, mechanically clamping front and rear walls 5 and 7 in place.

A lip to the front wall or short hollow metal tube 6, through which exhaust gas is admitted to the muffler, protrudes from front wall 5 as an extension to an inlet or passage 10 through the front wall into the muffler casing. Another like lip (to the rear wall) or short hollow metal tube 8 extends from rear wall 7 as an extension to an outlet passage, not visible in the figure, in rear wall 7, through which the exhaust gas is expressed from the muffler casing. Tube 6 is intended for connection via appropriate metal tubes to the catalytic converter found in most modern automobiles or directly to the exhaust manifold exhaust gas header of the engine, not illustrated, if a catalytic converter is not employed in the vehicle. Tube 8 is intended for connection to the tailpipe of the vehicle in which the muffler is installed. As one appreciates the exterior of the new muffler is essentially the same in appearance as existing mufflers and of essentially the same size. Such form and fit is expected for a muffler intended to replace an OEM muffler. The installation of the muffler in an automobile or truck is accomplished by customary means the details of which are not material to an understanding of the invention, and need not be described in detail. The elements that are important to the invention are located in the interior of the muffler case underlying casing 3, which is next considered in connection FIGS. 2 and 3 to which concurrent reference is made.

Figure 2:
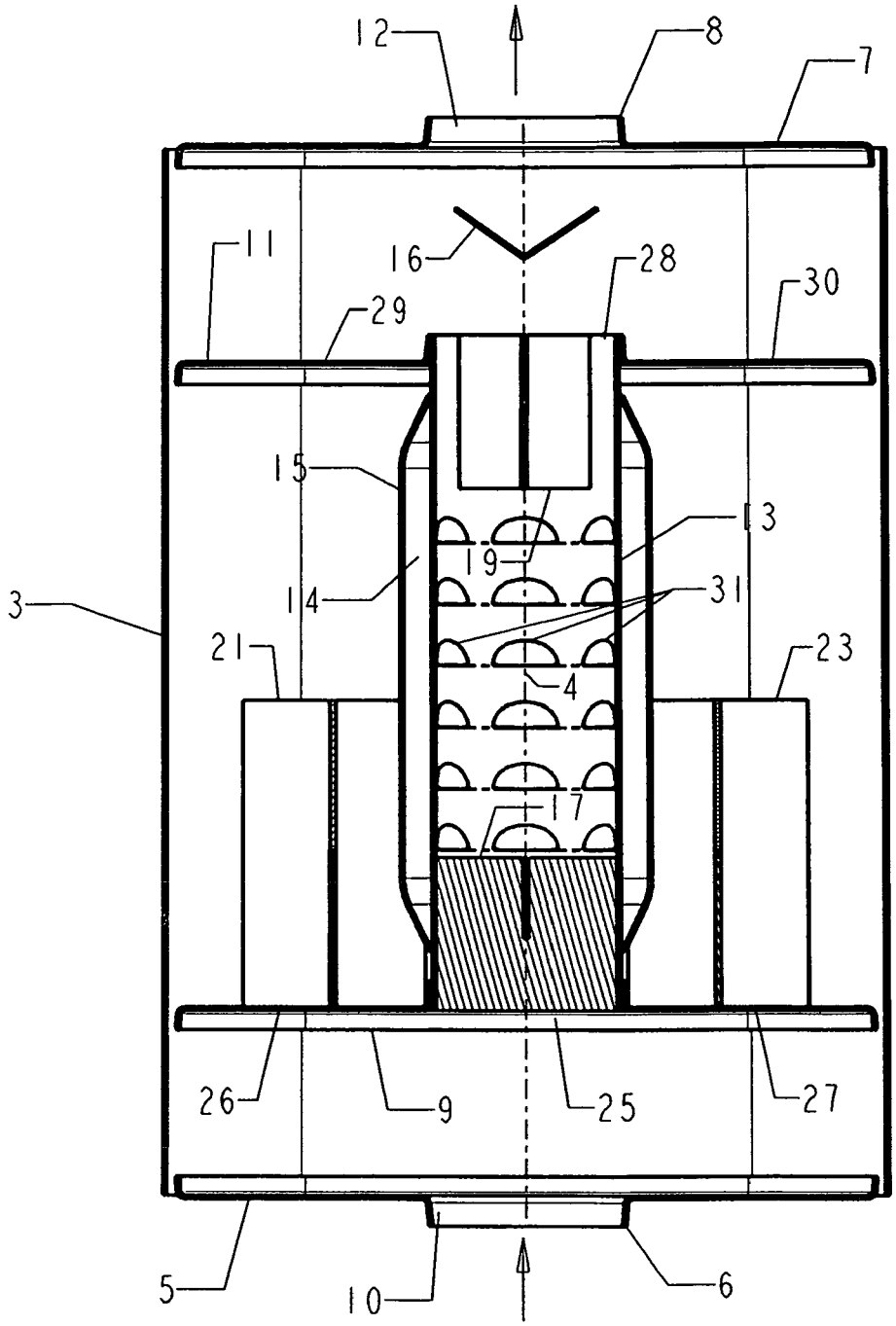
FIG. 2 is a not-to-scale pictorial section enlarged view of an embodiment of the invention taken along the lines 2—2 in FIG. 1.
Figure 3:
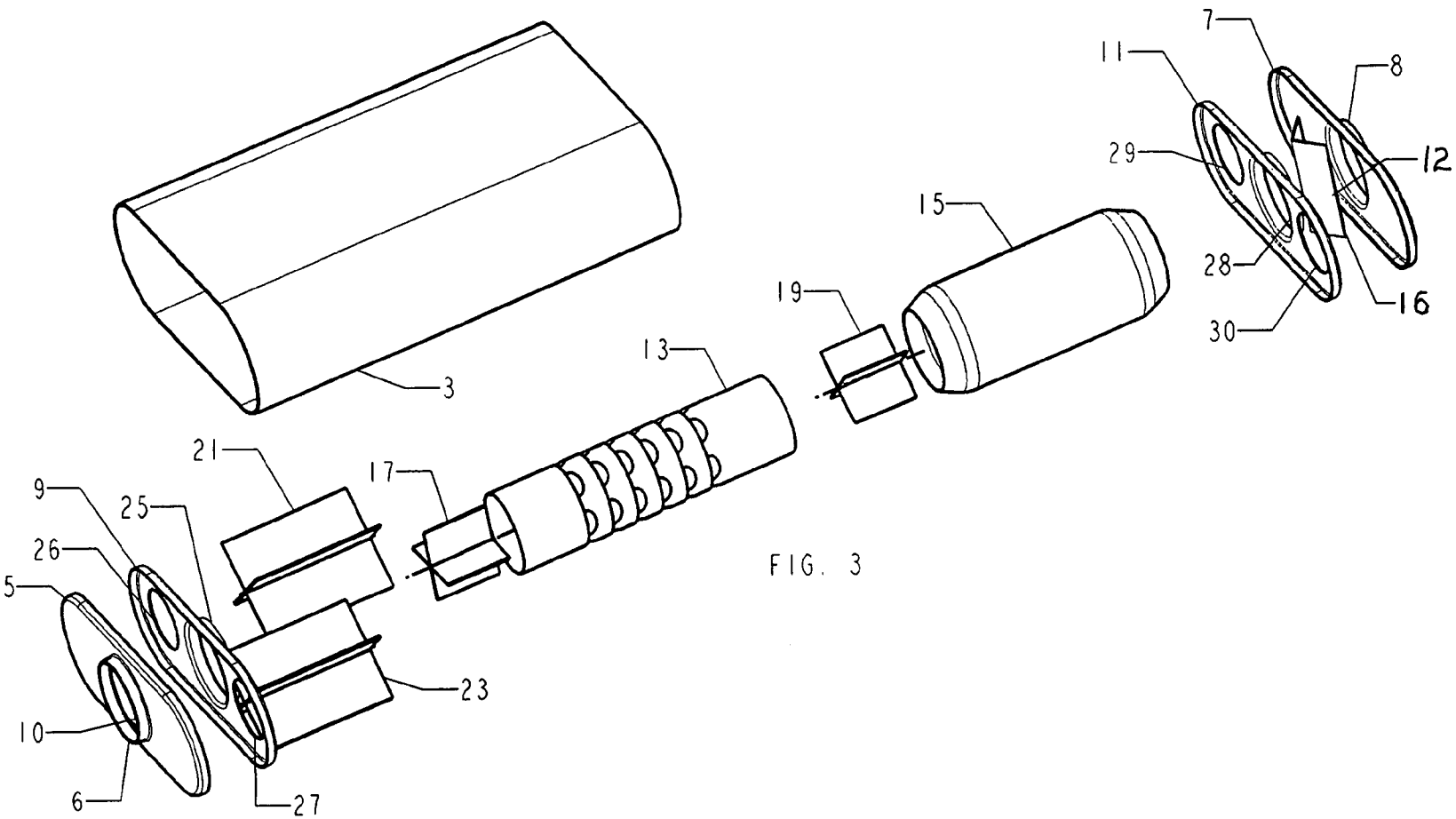
FIG. 3 illustrates the embodiment of FIG. 1 in an exploded view.

FIG. 2 is a pictorial section view of muffler 1, not drawn to scale, taken along the lines 2—2 in FIG. 1 while FIG. 3 illustrates the muffler of FIG. 1 in an exploded view. The elements in common to both figures and those common to those described in FIG. 1 are denominated by the same reference number initially given for the element in the figure in which the element is first referenced with a number. The front wall 5 of the muffler, protruding tube 6 and a circular gas inlet passage 10 formed in wall 5 are shown at the bottom of FIG. 2 and again in FIG. 3. Rear wall 7, short tube 8 and the gas outlet passage 12 formed in rear wall 7 appear at the top of FIGS. 2 and 3. The muffler also includes front and rear inner compartment walls 9 and 11, respectively, a louvered tubular member 13, a second tubular member 15 that contains conically tapered front and rear ends and ensleeves the louvered tubular member, an inlet divider baffle 17, outlet divider baffle 19, a pair of additional divider baffles 21 and 23, and, optionally, a deflector 16. The foregoing elements are all fabricated of an aluminized carbon steel alloy.

Compartment walls 9 and 11 are positioned at spaced distances along the longitudinal axis 4 of the muffler, and are longitudinally spaced, respectively, from the respective front and rear walls 5 and 7. The compartment walls are attached by tack welds to the front and rear ends, respectively, of louvered tubular member 13.

Figure 5:
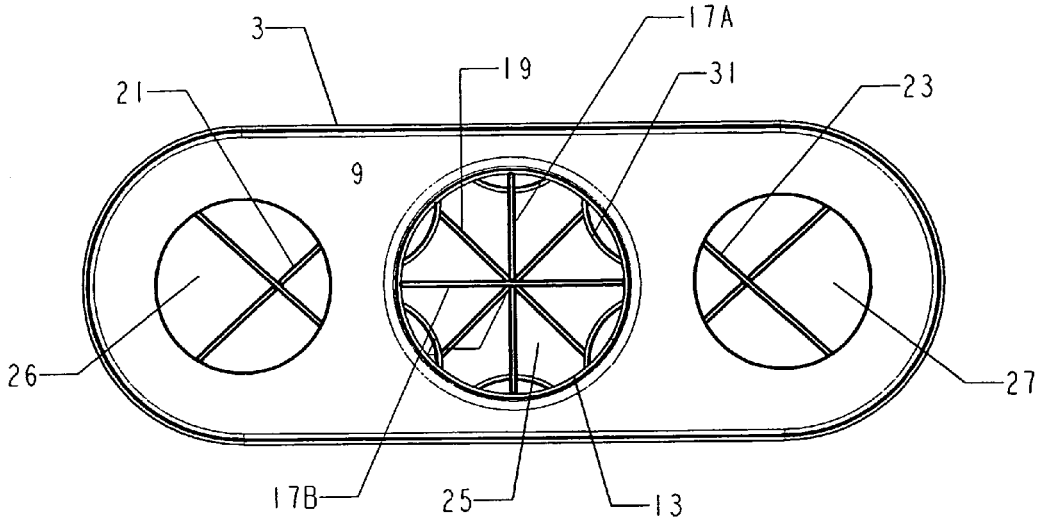
FIG. 5 is a front view of a compartment wall used at the inlet end of the muffler embodiment of FIGS. 2 and 3.

Reference is made to FIG. 5, which shows compartment wall 9 viewed from the front direction with front wall 5 omitted. The compartment wall contains a centrally positioned circular passage 25 and two smaller diameter circular passages 26 and 27, one on each side of central passage 25. As assembled, central passage 25 is centered on the axis 4 of the muffler and is aligned with circular inlet passage 10 in the front wall 5, not illustrated in this figure. In the preferred embodiment, the diameter of passage 25 is the same as the diameter of inlet passage 10. Referring to FIG. 3, rear compartment wall 11 likewise contains three circular openings, a central passage 28 and two side circular passages, 29 and 30, on either side of the central passage. The foregoing passages in rear compartment wall 11 are of like shape, size and relationship as the corresponding passages contained in front compartment wall 9. Elements 17, 21 and 23, which are referred to as divider baffles, are described more fully later herein.

Returning to FIG. 2, outer tubular member 15 fits over and overlies the louvered tubular member 13 to form therewith a coaxial subassembly. The diameter of tubular member 15 over most of the length is greater than the diameter of the louvered tubular member 13. The ends of member 15 are tapered inwardly, as example by a taper angle of twenty five degrees, to form a frusto-conical end shape at each of the front and rear ends. The ends of those tapered portions contact the outer surface of louvered tubular member 13 to which tubular member 15 attaches. The diameter of tubular member 15 is sufficiently greater than tubular member 13 so as to define, as assembled, an annular chamber 14 in the space that extends about the exterior cylindrical surface of louvered tubular member 13. Outer tubular member 15 is permanently attached to and supported by tubular member 13 at those points of contact there between at the front and rear ends, suitably by welds. The foregoing coaxial arrangement of tubes is better viewed in the section view of FIG. 6, to which reference is made.

Figure 6:
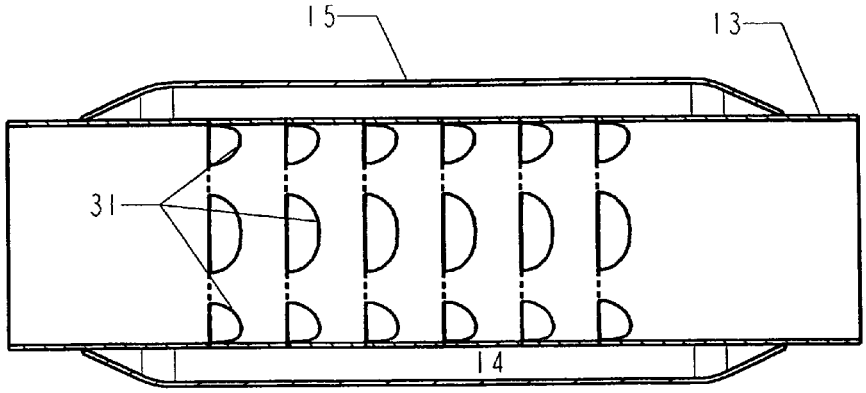
FIG. 6 is a section view of the tubular components 13 and 15 of the embodiment of FIG. 2 in assembled relationship.

The coaxial subassembly of tubular members 13 and 15 as assembled is illustrated in FIG. 6 in a side section view drawn in a larger scale. The cylindrical walls in the louvered tubular member 13 contain six rows of louvers 31. In this preferred embodiment, the rows of louvers are evenly spaced about the periphery of the tubular member, spaced about 60 degrees apart. Each row contains six louvers 31. The louvers are formed in the tubular member 13 using conventional fabrication techniques. As example, a short incision or cut is formed in the wall transverse the tube axis to form an edge and to one side of that cut the cylindrical side wall is stamped or pressed down with a die of the appropriate shape to depress and permanently radially inwardly deform a portion of the cylindrical side wall adjacent the cut. As illustrated, the louvers open to the inlet end of tubular member 13 and define small passages from the interior of that member into the overlying contiguous annular chamber 14.

Figure 7:
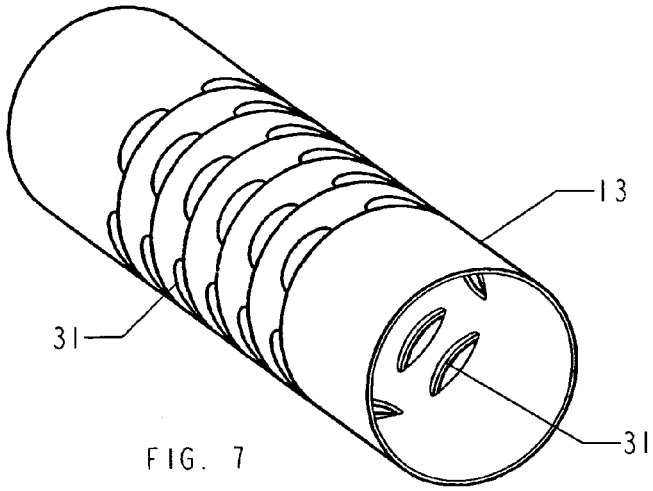
FIG. 7 is an isometric view of the inner tubular member 13 used in the embodiments of FIGS. 2 and 3.
Figure 8:
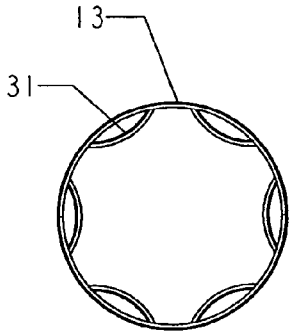
FIG. 8 is a front view of the tubular member of FIG. 7.

By facing in the direction of the tube inlet, located at the left in the figure, some portion of the incoming exhaust gas pulses that enters the tubular member diverts through the small passages formed by the louvers and enter annular chamber 14, building up the pressure in that chamber, while the remainder of the gas pulse continues travel in the axial direction toward the outlet end of the tube 13. As each pulse of gas travels along the tubular member, the portion of gas that entered that tubular chamber 14 may be sucked out of the annular chamber by the low pressure at the trailing end of the gas pulse and re-enter tubular member 13 to propagate to the outlet end, shown to the right, effectively modifying or smoothing the shape of the gas pulse that exits the outlet end of tube 13. Brief reference may be made to FIGS. 7 and 8, illustrating tubular member 13 in a slightly larger scale. Tubular element 13 is illustrated in FIG. 7 in an isometric view and FIG. 8 shows that tubular member from the front.

Referring again to FIG. 2, inlet divider baffle 17 and outlet divider baffle 19 each consist of two slotted flat panels that are assembled together into a crisscross configuration to divide a portion of the cylindrical passage through louvered member 15 into four sectors. The baffle construction is better illustrated in FIG. 4 to which brief reference is made.

Divider baffle 17 is formed of the two panels 17A and 17B, which are equal in size. Each contains a respective straight slot 32 and 33, respectively, that extends about halfway up the height of the panel. Those two pieces are frictionally joined at the slot, with panel 17A being moved to the in interlocked position with panel 1 7B as represented by the phantom lines. The foregoing interlocking technique of the panels is reminiscent of the now obsolete cardboard separators used in egg cartons in the distant past to separate the eggs.

Referring again to FIG. 5, divider baffle 17 is positioned inside louvered tubular member 13 and divides the passage in that tubular member into four individual passages that extend the length of the baffle. The baffle is slightly greater than one-fourth the length of louvered tubular member 13. At the end of the baffle, those four passages merge into the larger diameter hollow of the louvered tubular member.

Figure 4:
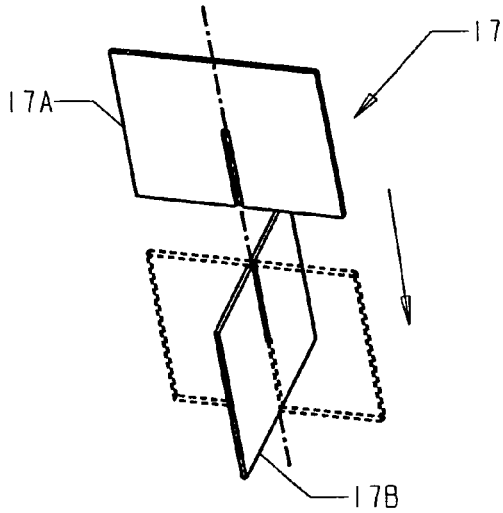
FIG. 4 illustrates the divider baffle 17 employed in the embodiment of FIGS. 2 and 3.

The foregoing baffle panels of divider baffle 17, ideally should be oriented perpendicular to one another as would define four quadrants. However, as seen in FIG. 2 to which reference is again made, the length of the baffle is great enough to extend into the region containing louvers 31, which are recessed into the interior of tubular member 13. To prevent the louvers from obstructing insertion of the barrier into place, it is necessary to fabricate the barrier panels at an angle other than ninety degrees, thereby clearing the louvers. For that reason the panels of barrier 17 define two pairs of sectors, with the sectors in each pair being of the same angular size, each pair being different in area. That is, each of the two sectors in a pair are identical in size and shape, but the sectors in the first pair differ in angular size and shape from the sectors defined in the second pair. To accomplish that configuration, the slots shown in FIG. 4 are not cut perpendicular to the surface of the respective panel 17A or 17B, but are cut through the surface of the panel at an acute angle to that surface.

The height of each panel 17A and 17B is essentially approximately equal to the inner diameter of louvered tubular member 13 so as to permit a friction fit between the inside walls of tubular member 13. This relationship is better illustrated in the end view of FIG. 5 to which reference is again made. As shown in the figure, the angles formed between panels that form baffle 17, namely panels 17A and 17B, fit inside the tubular member 13, viewed through opening 25 in front wall 9 and the outer edges of those panels abut the cylindrical inner wall of the louvered tubular member 13 to define between those panels and the cylindrical wall four sectors inside the cylindrical passage in tubular member 13. Two adjacent panels are separated by one angle, $\alpha$, and another two adjacent panels are separated by a different angle $\beta$.

As earlier noted, outlet baffle 19 is of the same structure as inlet baffle 17. Hence, the panels forming the outlet baffle are oriented relative to one another angularly by the same angles $\alpha$ and $\beta$, as in the panels of the inlet baffle. However, as installed in louvered tubular member 13, and, as illustrated in FIG. 5, the panels of baffle 19 are preferably oriented about the axis 4 of tubular member 13 by a different angle. That is, the corresponding panels in outlet baffle 19 are rotated in position so that they are not aligned with the panels of the inlet baffle. Preferably, the angle by which the panels of the inlet baffle 17 are angularly displaced from the angle of the corresponding panels of the outlet baffle 19 is about forty-five degrees.

Continuing with FIG. 5, louvered tubular member 13 is essentially the same inner diameter as the outer diameter of central opening 25 in compartment wall 9. Divider baffles 21 and 23 are each oriented with the outer edge extending across respective ones of side passages 26 and 27 and divides those passages into four areas or passages of equal size. As shown in FIG. 3, baffles 21 and 23 are identical in structure and are formed of panels of slightly greater height than baffles 17 and 19. Preferably, baffles 17 and 19 are oriented with the respective panels oriented at the same rotational angle. Divider baffle 21 is centrally positioned in circular side passage 26 and divider baffle 23 is centrally positioned in the other circular side passage 27. Each of those barrier members is supported in position by tack welding the radially outer edges of two of the panels that form the baffle to the outer wall of tubular member 15, as shown in FIG. 2.

Each of those divider baffles divides the circular side passage into four separate passages that extend to the length of the respective baffles, which is a portion of the length of the outer narrow cylindrical chamber formed between casing 3 and the outer surface of tubular member 15. Because the edges of the two panels of a barrier member abut the outer wall of tubular member 15, the passage defined between those two panel portions and tubular member 15 is a covered passage, and, hence, has different gas pressure propagation characteristics than the remaining three formed passages. One of the remaining three passages that is formed by panel members with radially outer edges located close to the wall of casing 3, provides a passage of a still different propagation characteristic from the other three passages. One of the remaining two passages is open on a side in the vertical up direction and the other passage is open on a side in the vertical down direction.

The divider baffles divide the exhaust gas that enters the respective side passage into four parts and defines a separate path inside chamber formed between the tubular member 15 and casing 3. As one appreciates, the latter divider baffles are fabricated in the same manner of baffles 17 and 19, earlier described.

Reference is again made to FIG. 3. Following fabrication of the component parts of the muffler, the muffler is assembled by sliding tubular member 15 over member 14 and tack welding the two members together. Divider baffle 17 is inserted into one end of the foregoing assembly at an angle that avoids contact with the louvers in the member, and is tack welded in place. Divider baffle 19 is inserted into the opposite end of the assembly, but is rotated by approximately forty-five degrees in angular orientation from the angular orientation of inlet baffle 17. When so aligned baffle 19 is tack welded in place. Compartment wall 9 is welded to the front of the tubular subassembly with the central passage 25 aligned with the cylindrical passage 10 in tubular member 13. Then compartment wall 11 is welded to the opposite end of that tubular member with the central circular opening 28 aligned with the circular opening in tubular member 13. Divider baffle 21 is centered in passage 26 and aligned with the front edge thereof confronting the rear side of compartment wall 9 and a radially outer edge of two of the panels in that baffle abutting the side wall of tubular member 15. Then the outer edge of that baffle is tack welded to that side wall of tubular member 15 and the front edge is tack welded to the compartment wall. In like manner divider baffle 23 is attached to compartment wall 9.

The foregoing assembly is then slid into casing 3 and properly spaced between the front and rear ends of that case. At this stage, the case remains open along a longitudinal seam, not illustrated. The front and rear walls 5 and 7 are positioned in the case and aligned with the foregoing assembly and the case is pressed closed clamping all the members between the side walls. The casing 3 is welded along the longitudinal seam to complete the muffler.

In the foregoing description, elements 17, 21 and 23 were referred to as divider baffles, since the baffles, as viewed in FIG. 5, divide the pulses of exhaust gas that are introduced into the compartment formed between front wall 5 and compartment wall 9 and is presented to each of passages 25, 26 and 27, where the exhaust gas at the entry into each passage is divided into four parts. Specifically divider baffle 21 at side passage 26 contains four different passages. Further, the flat sides of the baffles are capable of deflecting gas to the side as well. First, the panels defining the right hand sector has the radially outer edges abutting the outer surface of tubular member 15, which produces a closed passage. Likewise the panels defining the left hand sector has the radially outer edges close to or in contact with casing 5, producing another closed passage through the length of baffle 21. The panel sectors defining the upper sector are somewhat open on the outside edge and faces upward in the figure. Thus gas under force introduced into that passage may not only propagate along the barrier, but also expand upwardly. The panel sectors defining the lower sector are similarly open on the outer edge and face downward. Similarly, gas under force introduced into that passage may not only propagate along the barrier, but also expand downwardly. Those differences produce a difference in the propagation of the separate portions of introduced gas, which, in applicant's view, aids in the modification of the exhaust gas sound. One may have noted that the baffles are not used in the typical manner, which is to have the flat faces of the panels of the baffle oriented to face incoming gas. Instead, the baffles have the edges thereof facing the incoming gas.

In operation, the pulses of exhaust gas are inputted through passage 10 into the chamber behind front wall 5. Portions of that exhaust gas into each of the passages 25, 26 and 27 in compartment wall 9. Gas entering each passage is divided by the respective baffles. The gas entering the side passages 26 and 27 in the compartment wall 9 are divided into passages having four different characteristics previously described, wherein each portion is acts differently in progressing through the annular region on the exterior of tubular member 15 to any of the exit passages 29 and 30 in compartment wall 11. That action is believed to change the physical characteristic of the sound produced by the pressure pulses of the exhaust gas. The portion which passes through passage 25 and is divided into four streams by divider baffle 17 recombines at the end of the baffle, and some portions of the leading edge of the gas pulse pass through the louvers 31 into the annular chamber 14. As the trailing edge of that pulse passes those same louvers, the lower pressure of that trailing edge is believed to suck out the gas from the annular chamber, producing a modified gas pulse with a smoother pulse shape. That gas continues into baffle 19 and is again divided into four streams, which then emerge from passage 28 into the chamber in front of the end wall 7. In embodiments that include gas deflector 16, which is attached to wall 11, the gas is diverted in two sideways directions and into collision with gas exiting passages 29 and 30. The combined gases (and sound) exits passage 12 and enters the tailpipe of the vehicle from which the gas (and sound) are expressed into the environment. In embodiments that do not include gas deflector 16, the gas which exits passages 28, 29 and 30 collectively exit the muffler through passage 12.

Conventional theory of sound dampening in mufflers of the reactive type (that do not rely on sound absorbing materials) is stated to deaden sound of a given frequency (in the audible range) by producing a reflection of the sound from the end wall of the casing that arrives back at the inlet one-hundred and eighty degrees out of phase with the next peak of the sound pulse arriving at the inlet. The two sound pressures combine to produce a sound of much lower amplitude. Although the illustrated structure is not the structure used in the classical models, because sound cancellation is achieved by the structure, it is likely that the structure disperses the pulses of gas in such a way that sound cancellation occurs and/or the sound energy produced is transformed from those frequencies that produce annoyance to those softer tones of the performance sound. Being neither a mathematician or an acoustic engineer, but with many years of practical experience in mufflers, applicant is uncertain of the precise theory of operation of the structure, and necessarily leaves that analysis to those acoustic engineers who, reading this specification, find themselves better equipped to propound an appropriate theory of operation.

In a practical embodiment of the invention, the muffler length overall was 20 inches and 11.433 inches wide. The inlet 10 and outlet 12 were each 3 inches in diameter. The casing 3 was of sixteen gage carbon steel. The louvered tubular member 13 was 14 inches in length, 3 inches in diameter and formed of sixteen gage steel, and each of the six louvers in a row were spaced about one inch intervals and the louvers covered a length of the tubular member about six inches centered in the length of the tubular member. Outer tubular member 15 was formed of sixteen gage aluminized tube was 9.05 inches in length, and 3.95 inches in diameter over the major portion of the tube, which the end portions reduced to an inner diameter of 3.0 inches. The panels of the divider baffles 17 and 19 were of a maximal width of 2.875 inches, length of 4 inches and a slot dept of 2.06 inches and 0.0605 inches thick. The panel of divider buffers 21 and 23 were 3.875 inches in width and 5.0 inches in length with a slot length of 2.561 inches and thickness of 0.0605. The first and second compartment walls 9 and 11 were each about 9.28 inches wide by 4.176 inches in height, with central passage 25 about 2.9 inches in diameter, side passages 26 and 27 were 2.281 inches diameter and spaced apart 7.0 inches center-to-center and each side passage was spaced from central passage 25 by 3.5 inches center-to-center. The wall contained a lip on the rear side surrounding the central passage of 0.438 inches in height. Compartment wall 11 and the included side passages therein were identical to compartment wall 9.

The foregoing muffler accomplished the goal of both dampening exterior sound to within the legal limit, in some instances substantially dampened or eliminated the annoying resonance that occurred in engines when running at or through speeds of 2,000 to 2,300 rpm and eliminated the popping noises on deceleration. No hot spots were produced in the casing. It is believed that the structure produced greater turbulence and patterns that avoided the production of any vortex producing hot spots.

In practice, a muffler in accordance with the structure of the foregoing embodiment was used in a Ford Mustang brand passenger vehicle that contained a V-8 engine and a dual exhaust system. The muffler produced the desired performance sound and sufficient muffling of the engine exhaust without generating undesirable sounds inside the interior of the vehicle. A muffler in accordance with the foregoing embodiment was also used in an SUV that contained an eight cylinder engine. Again the muffler produced the desired performance sound and sufficient muffling of the engine exhaust. However, although the volume of sound generated within the interior of the SUV at the 2,200 rpm speed was reduced, the muffler failed to entirely eliminate that interior sound as was desired in that vehicle. Hence, some additional modification or "tweaking" of the structure appears necessary to eliminate the interior sound in that kind of vehicle, as may be accomplished in the near future.

Figures 9, 10:
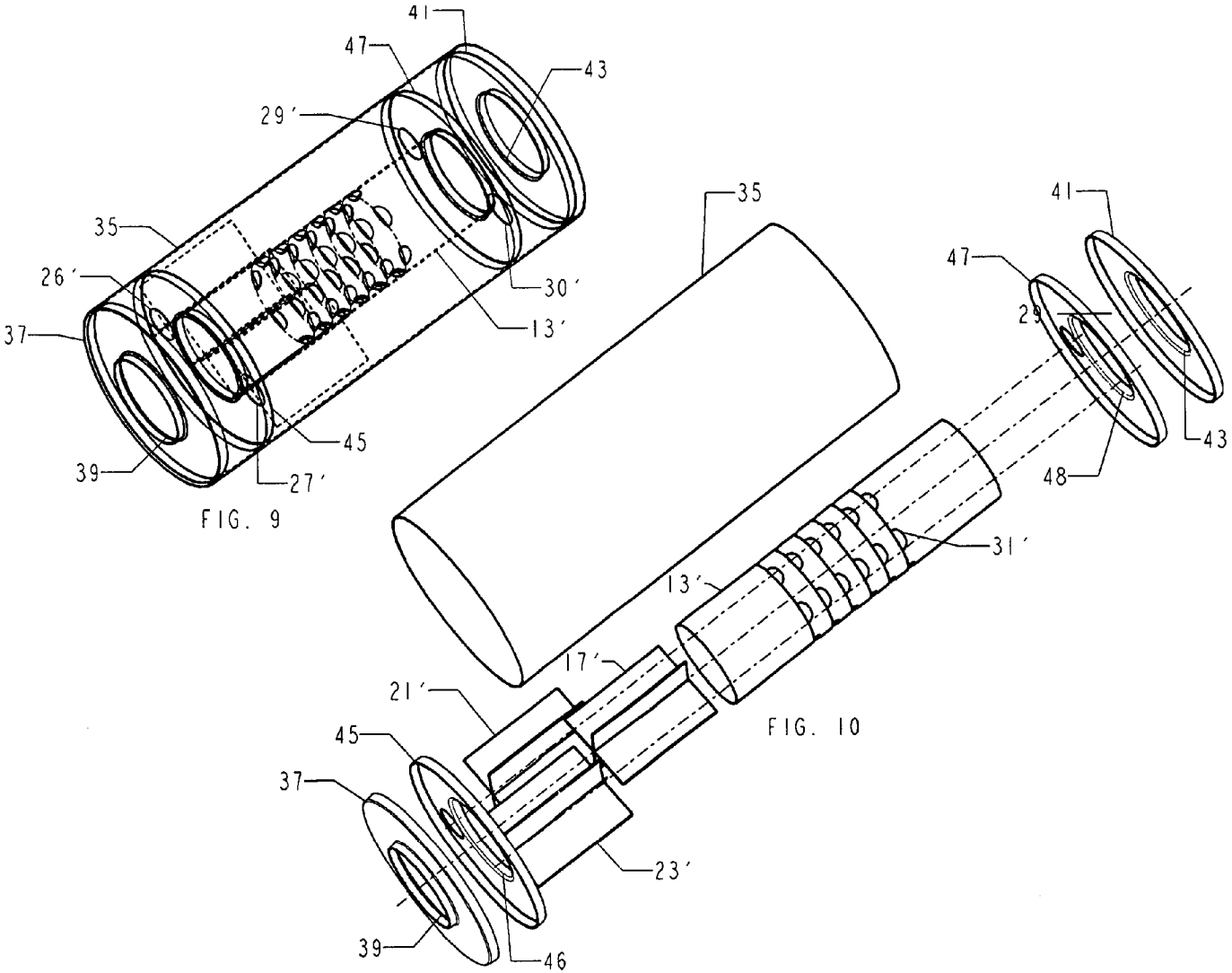
FIG. 9 illustrates a second embodiment of the invention particularly adapted to a diesel fueled internal combustion engine.
FIG. 10 illustrates the embodiment of FIG. 9 in an exploded view.
Figure 11:
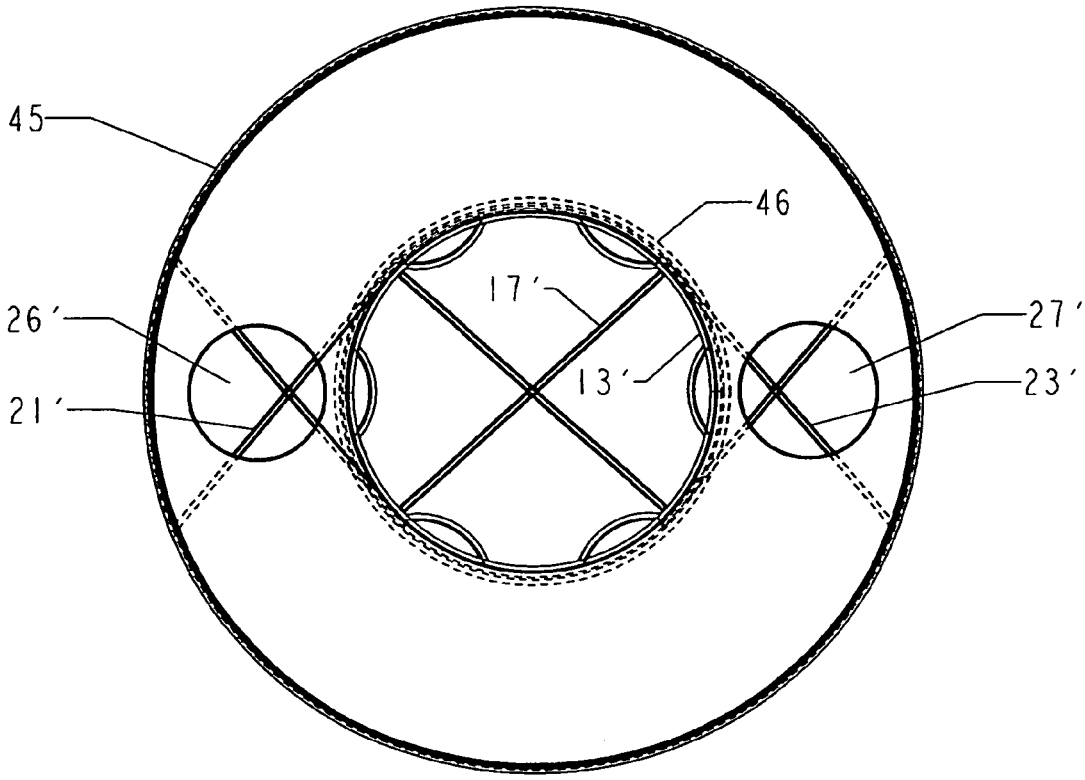
FIG. 11 is a front side view of the front of compartment wall 45 employed in the embodiment of FIGS. 9 and 10.

The foregoing embodiment of the invention is intended for a gasoline engine. Many automobiles and trucks now employ diesel fueled internal combustion engines, and those vehicles also require mufflers. Operated without a muffler, the sound generated during operation of the diesel engine is of an acceptable frequency or timbre to produce a performance sound, but the sound is loud and must be reduced in intensity, muffled. The external configuration or shape of the OEM mufflers used in diesel powered vehicles, typically trucks, differs from those used in most gasoline engines. Traditionally those mufflers are cylindrical in shape. Accordingly, a preferred muffler embodiment for a diesel fueled engine is illustrated in FIGS. 9 through 11. For convenience where the components of this embodiment contain elements that correspond to elements used in the preceding embodiment and share a like structure, the components are designated by the same numeral as in the prior embodiment and the numeral is primed.

Reference is made to FIG. 9, illustrating the exterior of the muffler with the assembled internal components illustrated in phantom lines. The muffler casing is cylindrical in shape. The front wall 37 of the muffler is circular and is joined to cylindrical side wall 35 along a circumferential lip formed on the front wall. A circular centrally located passage 39 in the front side, defined by a circular lip to the wall, serves as the inlet for receiving engine exhaust gases. Likewise the opposite end of the muffler includes a like circular end wall 41 with a centrally located outlet passage 43, defined by a lip to the end wall. The foregoing elements are illustrated in phantom lines, since those elements are not otherwise be visible in this view. Both the circular inlet and outlet gas passages 39 and 43 are centered along a common axis.

The exploded view of FIG. 10 to which reference is made provides a better view of the various elements of the embodiment of FIG. 9. A first compartment wall 45 at the inlet end of the muffler is spaced behind circular wall 37 at the front or inlet end of the muffler, and a second compartment wall 47 is located at the outlet end of the muffler spaced in front of circular end wall 41 at the exhaust or outlet end of the muffler. Both compartment walls are circular. Central passage 46 is of a much larger diameter than the diameter of passages 26' and 27'. Compartment wall 45 contains two circular side passages, 26' and 27', better illustrated in FIG. 9, spaced on opposite sides of a central passage 46, but only one of those two circular side passages is visible in FIG. 10. Compartment wall 47 likewise includes two circular passages 29' and 30', also better illustrated in FIG. 9, spaced on opposite sides of central passage 48 in the wall, but only one of those side passages 29' is visible in FIG. 10. The embodiment of FIG. 10 also includes a louvered tubular member 13', a divider baffle 17' that fits inside of louvered tubular member 13', and includes divider baffles 21' and 23'. Unlike the first embodiment, the muffler does not include a baffle at the rear end of louvered tubular member 13' or an outer cylindrical sleeve 15 to overlie that louvered tubular member. Referring back to FIG. 9, as assembled, the ends of louvered tubular member 13' are supported inside casing 35 by inserting the opposite ends of tubular member 13' inside the respective central openings or passages 46 and 48 in compartment walls 45 and 47, respectively.

Reference is next made to FIG. 11, which illustrates a front view of the first inner compartment wall 45 as viewed with the front circular wall 37 removed. The edges of divider baffle 17' appear in the central passage 46 in compartment wall 45. Likewise the side edges of divider baffle 21' is visible in circular side passage 26' in compartment wall 45 and the edges of divider baffle 23' are visible in the circular side passage 27' in that compartment wall. Those baffles are formed of two panels oriented at right angles to one another, forming a cris-cross arrangement.

As earlier described, baffle 17' is positioned inside louvered tubular member 13' and divides the passage in that tubular member into four individual passages that extend the length of the baffle; and the baffle is slightly less than one-half the length of the louvered tubular member. Those four passages then merge at the end of the baffle into the larger diameter hollow of the louvered tubular member. That tubular member is essentially the same inner diameter as the outer diameter of central opening 46 in compartment wall 45. As illustrated, the front edges of the two panels that form baffle 17' are not perpendicular, but are at a different angle, as measured by the two upper left panel portion, of approximately one-hundred and five degrees. This slight departure from the perpendicular is to allow the insertion of the baffle inside the louvered tubular member 13' without being obstructed by the individual louvers in the tubular member which recess into the inside of the tubular member. As shown in the side view of the louvered tubular member 13 earlier presented in FIG. 8, the edges of the individual louvers 31 recess into the inner hollow of tubular member 13. Tubular member 13 is essentially the same structure as tubular member 13' in the present embodiment. The difference in alignment between the walls of the baffle is a manufacturing accommodation, and does not appear to adversely affect the operation of the muffler.

Divider baffle 21' is centrally positioned in circular side passage 26' and barrier 23' is centrally positioned in the other circular side passage 27'. Each of those barrier members is supported in position by tack welding the radially outer edges of two of the panels that form the baffle to the outer wall of louvered tubular member 13', which is the same kind of attachment used in the prior embodiment. Each of those barrier members divides the circular side passage into four separate passages that extend to the length of the barrier member, as illustrated in FIG. 9, which is a portion of the length of the outer narrow cylindrical chamber formed between casing 35 and the outer surface of louvered tubular member 13'. Because the edges of the two panels of a baffle abut the outer wall of member 13', the passage that is defined between those two panel portions and the tubular member 13', one of the four sections, is a covered passage, and, hence, has different gas pressure propagation characteristics than the other three passages. One of the remaining three passages is formed by other panel members that are close to the wall of casing 35, providing a passage of a still different propagation characteristic from the other two passages. One of the remaining two passages is open on a side in the vertical up direction and the other passage is open on a side in the vertical down direction.

In operation, the pulses of exhaust gas are inputted through passage 39 into the chamber behind front wall 37. Portions of that exhaust gas into each of the passages 25', 26' and 27' in compartment wall 37. Gas entering each passage is divided by the respective baffles. The gas entering the side passages 26' and 27' in compartment wall 37 are divided into four passages which have different physical characteristics, and each portion of gas reacts differently in progressing through the annular region on the exterior of louvered tubular member 13 to any of the exit passages 29' and 30' in compartment wall 47. That action is believed to change the physical characteristic of the sound produced by the pressure pulses of the exhaust gas. The portion of exhaust gas which passes through passage 25' and is divided into four streams by divider baffle 17' inside louvered tubular member 13' recombines at the end of the baffle. Some portions of the leading edge of the gas pulse pass through the louvers 31' into the annular chamber on the exterior of member 13'. As the trailing edge of that pulse passes those same louvers, the lower pressure of that trailing edge is believed to suck gas from the annular chamber, producing a modified gas pulse with a smoother pulse shape. That gas continues through the louvered tubular member and emerges from passage 48 into the chamber in front of the end wall 41. In that chamber the portions of gas exiting each of the passages 29', 30' and 48 combine. The combined gases (and sound) exit passage 43 and enters the tailpipe of the vehicle from which the gas (and sound) are expressed into the environment. The foregoing proved to achieve the desired muffling of a diesel engine, gave a performance sound, did not develop hot spots nor create any annoying sounds in the interior of the vehicle.

In a practical embodiment of this second embodiment of the invention the muffler was a 8.621 diameter cylinder and of a length of 20 inches. Compartment wall 45 was 8.5 inches in diameter and was formed in 16 gage aluminized steel sheet, central passage 46 was 4.0 inches in diameter and side passages 26' and 27' were 1.5 inches in diameter; and those passages were spaced apart by 6 inches center-to-center with each side passage located 3.0 inches from the central passage measured center-to-center. The rear surface of the wall contained a lip of 0.37 inch height surrounding the central opening. The inlet passage 39 in front wall 37 and outlet passage 43 in rear wall 41 were each 4.0 inches in diameter and those walls were 8.5 inches in diameter. The panels forming the divider baffles 17', 21' and 23' were each 3.875 inches in width and 5.0 inches in length and contained a 2.561 inch slot. The louvered tubular member 13' was 14 inches in length and of a diameter large enough to accommodate divider baffle 17'. Other aspects of the louvers were the same as in the preceding practical embodiment.

It is believed that the foregoing description of the preferred embodiments of the invention is sufficient in detail to enable one skilled in the art to make and use the invention without undue experimentation. However, it is expressly understood that the details of the elements comprising those embodiments that were presented for the foregoing purpose is not intended to limit the scope of the invention in any way, in as much as equivalents to those elements and other modifications thereof, all of which come within the scope of the invention, will become apparent to those skilled in the art upon reading this specification. Thus, the invention is to be broadly construed with the full scope of the appended claims.

The invention claimed is:

1. An exhaust muffler for an internal combustion engine, comprising a casing;

said casing including a front wall, a rear wall and a side wall;

said side wall extending in a loop about said front and rear walls, said front wall including an exhaust gas inlet and said rear wall including an exhaust gas outlet;

a first compartment wall;

said first compartment wall including a first central circular passage and a first pair of side circular passages, said side circular passages of said first pair of side circular passages being respectively located equally spaced on opposite sides of said first central circular passage; and said side circular passages of said first pair of side circular passages being smaller in area than the area of said first central circular passage, a second compartment wall;

said second compartment wall including a second central circular passage and a second pair of side circular passages, said side circular passages of said second pair of side circular passages being respectively located equally spaced on opposite sides of said second central circular passage; said side circular passages of said second pair of side circular passages being smaller in area than the area of said second central circular passage;

said first compartment wall being mounted in said casing behind said front wall of said casing with said first central passage of said first compartment wall being aligned with and spaced from said exhaust gas inlet and with the outer periphery of said first compartment wall being in contact with said side wall of said casing to define a first compartment within said casing;

said second compartment wall being mounted in said casing spaced in front of said rear wall of said casing with said second central circular passage in said second compartment wall being aligned with said exhaust gas outlet in said rear wall of said casing and with the outer periphery of said second compartment wall being in contact with said side wall of said casing to define a second compartment in said casing;

first and second gas divider baffles;

said first gas divider baffle for dividing a first side circular passage of said pair of side circular passages in said first compartment wall into a plurality of passages, said first gas divider baffle being positioned behind said first compartment wall in confronting relationship with said first side circular passage of said pair of side circular passages;

said second gas divider baffle for dividing a second side circular passage of said pair of side circular passages in said first compartment wall into a plurality of passages, said second gas divider baffle being positioned behind said first compartment wall in confronting relationship with said second side circular passage of said pair of side circular passages;

a first elongate tubular member, said first elongate tubular member having an axis and front and rear ends, and being of a first predetermined diameter and first predetermined length; said first tubular member including an entrance at said front end for receiving exhaust gas within the interior of said tubular member and an exit at said rear end for permitting exit of exhaust gas from the interior of said tubular member;

said first elongate tubular member being positioned inside said casing in between said first and second compartment walls with said entrance at said front end being aligned with said central opening in said first compartment wall for receiving exhaust gas from said first compartment and with said exit at said rear end being aligned with said central opening in said second compartment wall for permitting exhaust gas to exit into said second compartment;

said first elongate tubular member including a plurality of small gas passages through the side of said first elongate tubular member for permitting passage of exhaust gas between the interior and exterior of said first tubular member;

said plurality of small gas passages in said first tubular member being arranged in a plurality of rows, each of said rows extending longitudinally of said first tubular member, said rows of said plurality of rows being equally angularly spaced about said axis of said first tubular member; and a third divider baffle located in the interior of said first tubular member;

said third divider baffle being positioned at said entrance of said first tubular member and extending inside said first tubular member a first predetermined longitudinal distance along said axis of said first tubular member for dividing a portion of the interior of said first tubular member into a plurality of sectors, wherein exhaust gas entering said tubular member is divided into a plurality of streams of exhaust gas over said first predetermined longitudinal distance.

2. The exhaust muffler as defined in claim 1, wherein said plurality of passages in said first and second divider baffles comprises four and wherein said plurality of sectors defined by said third divider baffle comprises four.

3. The exhaust muffler as defined in claim 2, wherein each of said front and rear walls of said casing comprises a circular geometry, and wherein said sidewall of said casing comprises a cylindrical geometry.

4. The exhaust muffler as defined in claim 3, wherein each of said first and second compartment walls comprise a cylindrical geometry.

5. The exhaust muffler as defined in claim 1, wherein each of said first, second and third divider barriers each comprise first and second flat rectangular panels, each of said panels including a slot extending part way through the midsection of the respective panel; said panels being interlocked by said slots in a crisscross relationship.

6. The exhaust muffler as defined in claim 1, wherein said plurality of rows of small gas passages in said first tubular member comprises six and wherein the number of small gas passages in each said row comprises six.

7. The exhaust muffler as defined in claim 4, wherein each of said first, second and third divider barriers each comprise first and second flat rectangular panels, each of said panels including a slot extending part way through the midsection of the respective panel; said panels being interlocked by said slots in a crisscross relationship; and wherein said plurality of rows of small gas passages in said first tubular member comprises six and wherein the number of small gas passages in each said row comprises six.

8. The exhaust muffler as defined in claim 7, wherein said plurality of rows of small gas passages in said first tubular member comprises six and wherein the number of small gas passages in each said row comprises six.

9. The exhaust muffler as defined in claim 1, further comprising:

a fourth divider baffle;

said fourth divider baffle being located in the interior of said first tubular member positioned at said exit of said first tubular member spaced from said third divider baffle and extending inside said first tubular member a second predetermined longitudinal distance along said axis of said first tubular member for dividing a portion of the interior of said first tubular member adjacent said exit into a plurality of sectors, wherein exhaust gas passing through the interior of said tubular member to said exit of said tubular member is divided into said plurality of streams of exhaust gas over said second predetermined longitudinal distance and exits said tubular member as a plurality of streams of exhaust gas.

10. The exhaust muffler as defined in claim 9, further comprising:

a second tubular member, said second tubular member being of a second predetermined length and diameter and having front and rear ends, and including inwardly tapered frusto-conical front and rear end portions;

said second predetermined diameter of said second tubular member being greater than said first predetermined diameter and said second predetermined length being approximately equal to said first predetermined length; and said second tubular member being mounted coaxial with, supported by and ensleeving said first tubular member, with said front and rear end portions abutting said first tubular member, to define an annular chamber between said first and second tubular members.

11. The exhaust muffler for an internal combustion engine as defined in claim 10, further comprising:

a gas deflector;

said gas deflector being located in said gas exit region between said second central circular passage of said second compartment wall and said exhaust gas outlet for blocking direct propagation of exhaust gas exiting from said first tubular member from direct access to said exhaust gas outlet of said muffler and deflecting exhaust gas off the axis of said first tubular member.

12. The exhaust muffler as defined in claim 8, further comprising:

a fourth divider baffle;

said fourth divider baffle being located in the interior of said first tubular member positioned at said exit of said first tubular member spaced from said third divider baffle and extending inside said first tubular member a second predetermined longitudinal distance along said axis of said first tubular member for dividing a portion of the interior of said first tubular member adjacent said exit into a plurality of sectors, wherein exhaust gas passing through the interior of said tubular member to said exit of said tubular member is divided into said plurality of streams of exhaust gas over said second predetermined longitudinal distance and exits said tubular member as a plurality of streams of exhaust gas.

13. The exhaust muffler as defined in claim 12, wherein said plurality of sectors defined by said fourth divider barrier comprises four.

14. The exhaust muffler as defined in claim 13, wherein said fourth divider barrier comprises first and second flat rectangular panels, each of said panels including a slot extending part way through the midsection of the respective panel; said panels being interlocked by said slots in a crisscross relationship.

15. An exhaust muffler for an internal combustion engine, comprising a casing;

said casing including a front wall, a rear wall and a side wall, said front wall including an exhaust gas inlet and said rear wall including an exhaust gas outlet;

a first compartment wall;

said first compartment wall including a first central circular passage and a first pair of side circular passages, said side circular passages being located on opposite sides of said first central circular passage and being equally spaced from said first central passage; said side circular passages of said first pair of side circular passages being smaller in area than the area of said first central circular passage, a second compartment wall;

said second compartment wall including a second central circular passage and a second pair of side circular passages, said side circular passages of said second pair of side circular passages being located on opposite sides of and equally spaced said second central circular passage; said side circular passages of said second pair of circular passages being smaller in area than the area of said second central circular passage;

a first tubular member, said first tubular member having an axis and front and rear ends, and being of a first predetermined diameter and first predetermined length; said first tubular member including an entrance at said front end and an exit at said rear end; and said entrance and exit being aligned along said axis of said first tubular member;

a second tubular member, said second tubular member being of a second predetermined length and diameter and having front and rear ends, and said second tubular member including inwardly tapered frusto-conical front and rear end portions;

said second predetermined diameter of said second tubular member being greater than said first predetermined diameter and said second predetermined length being approximately equal to said first predetermined length;

said second tubular member being mounted coaxial with and supported by and ensleeving said first tubular member, with said front and rear end portions abutting said first tubular member, to define a first annular chamber between said first and second tubular members;

said first tubular member including a plurality of small gas passages in the side of said first tubular member for permitting passage of exhaust gas between the interior of said first tubular member and said first annular chamber;

said plurality of small gas passages in said first tubular member being arranged in a plurality of rows, each of said rows extending longitudinally of said first tubular member, said rows of said plurality of rows being equally angularly spaced about said axis of said first tubular member;

said first compartment wall being mounted in said casing transverse the axis of said first tubular member with said first central passage of said first compartment wall being aligned with and spaced from said exhaust gas inlet and said front wall of said casing and with the outer periphery of said first compartment wall being in contact with said wall of said casing to define a gas entry region in said casing; and said second compartment wall being mounted in said casing transverse said axis of said first tubular member and spaced from said rear wall of said casing with said second central circular passage in said second compartment wall being aligned with said first central circular passage of said first compartment wall and with the outer periphery of said second compartment wall being in contact with said wall of said casing to define a gas exit region in said casing; and wherein said first and second compartment walls, said wall of said casing and the exterior of said second tubular member defining a second annular region in said casing;

wherein said side circular passages of said first pair of side circular passages of said first compartment wall provide passages into said second annular region for a portion of exhaust gas introduced within said gas entry region through said exhaust gas inlet; and wherein said side circular passages of said second pair of side circular passages of said second compartment wall provide passages from said second annular region for exhaust gas in said second annular region to pass into said gas exit region;

said first tubular member being mounted in said casing extending between said first and second compartment walls with said entrance of said first tubular member being coupled to said first central circular passage in said first compartment wall to permit exhaust gas entering said exhaust gas inlet to enter said interior of said first tubular member and with said outlet of said first tubular member being coupled to said second central circular passage of said second compartment wall to permit exhaust gas exiting said first tubular member to pass into said gas exit region and to said exhaust gas outlet;

first and second gas dividers located in the interior of said first tubular member, said first and second gas dividers being spaced apart along said axis of said first tubular member;

said first gas divider being positioned at said entrance of said first tubular member and extending inside said first tubular member a first predetermined longitudinal distance along said axis of said first tubular member for dividing a front portion of the interior of said first tubular member into four sectors;

said second gas divider being positioned at said rear of said first tubular member and extending inside said first tubular member a second predetermined longitudinal distance along the axis of said first tubular member for dividing a rear portion of the cylindrical interior of said first tubular member into four sectors;

said first gas divider being oriented about the axis of said first tubular member by a first angular extent and said second gas divider being oriented about said axis of said first tubular member by a second angular extent, whereby said four sectors defined by said first gas divider are out of alignment with said four sectors defined by said second gas divider;

third and fourth gas dividers;

said third gas divider being positioned in said second annular region and in one of said circular side passages of said first pair of side circular passages of said first compartment wall and said fourth gas divider being positioned in said second annular region and in the other of said circular side passages of said first pair of circular side passages of said first compartment wall;

each of said third and fourth gas dividers for parsing into four parts exhaust gas entering said second annular region through the respective circular side passages.

16. The exhaust muffler for an internal combustion engine as defined in claim 15, further comprising:

a gas deflector;

said gas deflector being located in said gas exit region between said second central circular passage of said second compartment wall and said exhaust gas outlet for blocking direct propagation of exhaust gas exiting from said first tubular member from direct access to said outlet of said muffler and deflecting that exhaust gas to the sides off-axis of said axis of said first tubular member.

17. The exhaust muffler for an internal combustion engine as defined in claim 15, wherein said angular spacing between said plurality of longitudinally extending rows of said small gas passages in said first tubular member is equal.

18. The exhaust muffler for an internal combustion engine as defined in claim 17, wherein said plurality of longitudinally extending rows in number comprise four.

19. The exhaust muffler for an internal combustion engine as defined in claim 15, wherein said small gas passages comprise louvers, said louvers facing said inlet end of said first tubular member.

20. The exhaust muffler for an internal combustion engine as defined in claim 19, wherein the number of small gas passages in each row of plurality of rows of small gas passages comprise six.

* * * * *